United States Patent [19]

Schwalm

[11] 4,174,097

[45] Nov. 13, 1979

[54] FURNACE FOR BRIGHT ANNEALING OF COPPER

[75] Inventor: Donald J. Schwalm, Northville, Mich.

[73] Assignee: Holcroft & Company, Livonia, Mich.

[21] Appl. No.: 848,155

[22] Filed: Nov. 3, 1977

[51] Int. Cl.[2] ..... F27B 9/04

[52] U.S. Cl. ..... 266/87; 266/254; 266/259

[58] Field of Search ..... 266/87, 24, 257, 259; 432/260

[56] References Cited

U.S. PATENT DOCUMENTS

| | | | |
|---|---|---|---|
| 3,032,326 | 5/1962 | Hepburn | 266/87 X |
| 3,496,033 | 2/1970 | Gilbreath et al. | 266/87 X |
| 3,517,916 | 6/1970 | Ross et al. | 266/87 |

*Primary Examiner*—Paul A. Bell

*Attorney, Agent, or Firm*—Whittemore, Hulbert & Belknap

[57] ABSTRACT

The invention relates to controlled atmosphere heat treating furnaces and particularly to furnaces for bright annealing of copper or its alloys. A new concept is proposed for conserving energy uses by first having a separate atmosphere producing system that fires constantly, independent of the temperature control and secondly having a cooling system that only extracts the excess heat produced by the combustion for atmosphere. In this way the furnace may be maintained at the desired operating temperatures regardless of variation of the work load, yet all of the heat generated by the atmosphere producing device is released within the furnace thereby eliminating unnecessary heat losses.

8 Claims, 3 Drawing Figures

CURTAINS
WATER COOLING CURTAINS
UNLOADING TABLE AREA
ANNEALING FURNACE
LOADING AREA CHARGE TABLE
CURTAINS

FURNACE FOR BRIGHT ANNEALING OF COPPER

BACKGROUND OF THE INVENTION

The present invention is of importance for bright annealing of copper or copper alloys. To accomplish this purpose it is necessary to heat and cool the copper in an atmosphere that prevents an undesired chemical reaction on the surface of the copper. The protective atmosphere most commonly used is lean exothermic produced by the controlled combustion of a hydro-carbon fuel, normally natural gas, with air. To date there have been two basic approaches to the generation of this atmosphere, either externally in a separate chamber or internally in the furnace proper. There have been disadvantages to both approaches.

External atmosphere generation, the presently preferred approach, is easier to control and more reliable. However, the heat generated by combusting the hydrocarbon fuel has been to date wasted. And in today's energy crisis this is a definite disadvantage.

The internally produced atmosphere approach has the potential of utilizing all or at least much of the heat released in producing the atmosphere. But, to date there have been design problems.

First, it is extremely difficult to maintain the correct air to fuel ratio because the heat load of the furnace changes as the processing conditions change. The variation in operating pressures through the combustion system as the temperature control zones change the burner firing rates complicates the ratio control.

Second, as the through-put of copper product is reduced or stopped the heat requirement of the furnace falls below that released in producing sufficient atmosphere. Therefore, it has been necessary to incorporate a separate heat loss on/in the furnace to absorb the extra heat released by the combustion for producing atmosphere. This separate heat loss has normally been in the form of a constant energy drain on the furnace. Consequently, the energy savings have been minimized.

SUMMARY OF THE INVENTION

The present invention improves these two design deficiencies by first having a separate atmosphere producing system that fires constantly, independent of the temperature control system and secondly having a cooling system that only extracts the excess heat produced by the combustion for atmosphere.

The invention utilizes a conventional burner system of the type heretofore used only externally of the furnace but places such burner system internally within the furnace. This burner system fires constantly independently of the furnace temperature control system. Ratio control to produce the desired inert annealing atmosphere is accomplished in the same manner and with the same reliability as the conventional external burner system.

Since the burner system is exothermic and is within the furnace, the heat thereby produced raises the temperature of the furnace and by proper pre-setting of the burners, the desired temperatures in the several furnace zones can be maintained for normal operation when the work load of copper passing through the furnace is at an optimum level.

If during operation the temperature of any zone is above or below that desired for the annealing operation, adjustment and regulation is obtained by auxiliary heating and/or cooling means, which are automatically operated by the temperature controlling system. In this way the proper temperatures can be maintained in the furnace without continually regulating the gas ratios for the atmosphere producing burners.

The objectives of the invention and the advantageous results obtained thereby will be more fully set forth after describing a preferred embodiment.

DESCRIPTION OF A PREFERRED EMBODIMENT

Figures 1, 2, 3:
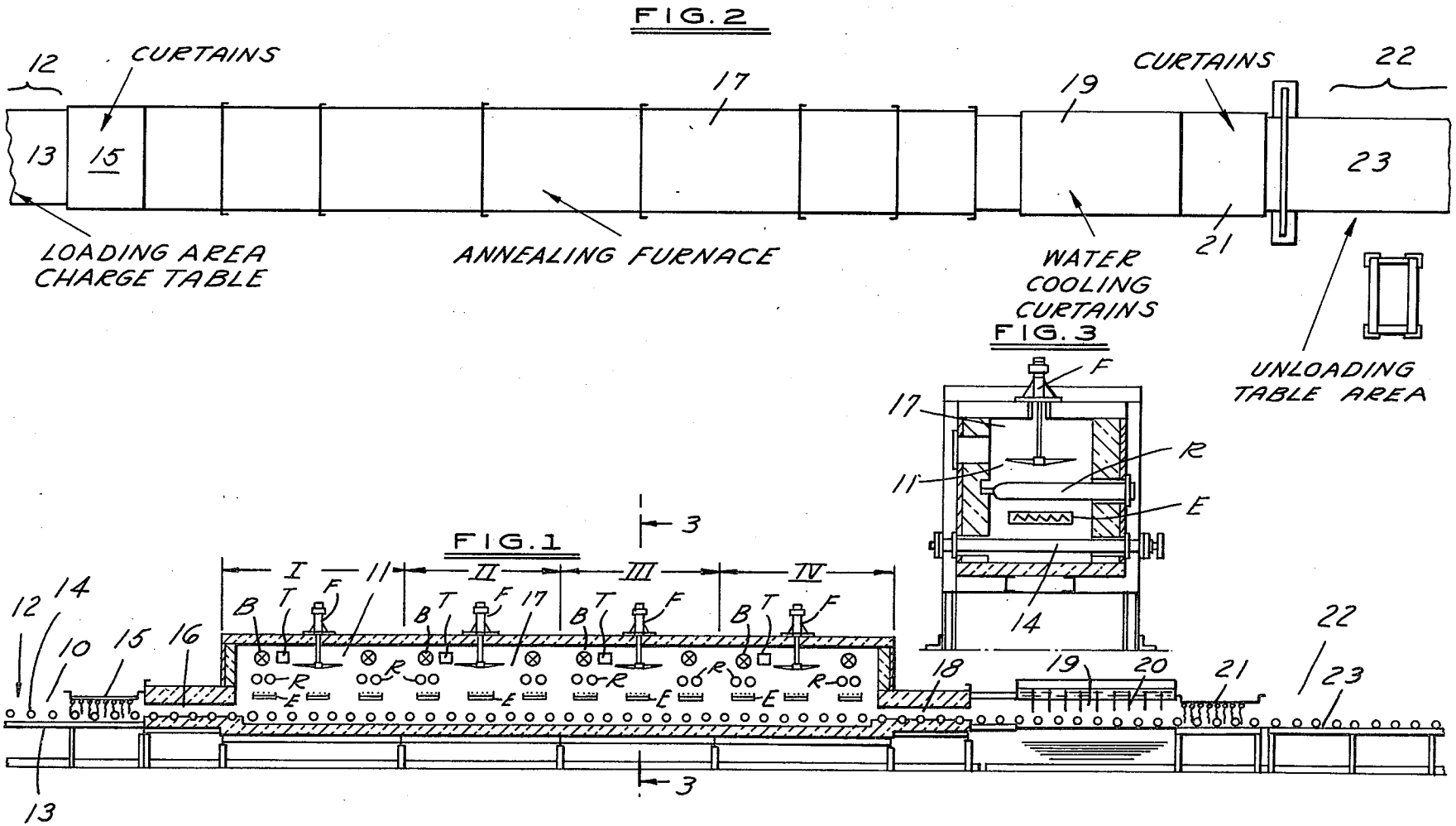
FIG. 1 is a sectional elevation of a furnace shown schematically.
FIG. 2 is a schematic plan view thereof.
FIG. 3 is a transverse section on line 3—3 of FIG. 1.

FIGS. 1 to 3 represent a heat-treating furnace designed for bright annealing of copper. In general construction the furnace is of conventional design for transporting the copper to be annealed by a conveyor 10 through a tunnel 11 in which the heat treating is performed. There is a loading area 12 which includes a charge table 13. The copper work load is placed on the rollers 14 and advanced by the driving system of the conveyor through the curtain zone 15 and the low ceiling entrance zones 16 into the annealing furnace 17. At the discharge end of the furnace is a low ceiling exit zone 18, a cooling section 19 containing water cooling curtains 20 and a curtain zone 21. The cooled copper load travels then to an unloading area 22 which includes a discharge table 23. The preceding description represents a conventional annealing apparatus designed to operate automatically with whatever copper work load requiring annealing treatment.

Within the tunnel 11 of the heat treating portion of the annealing furnace there is an atmosphere producing burner system B and four successive heat treating zones I, II, III and IV. Each of these zones is provided with a radiant heating and/or cooling system R, and in some instances supplementary electric heating devices E. Each zone may also have a fan F for circulating the heated atmosphere and a thermostat T for regulating the temperature within the zone.

The atmosphere producing burners B are each of conventional design such as are normally located externally of the heat treating furnace. Each is provided with a supply of fuel and air with means for regulating the ratio in order to get the desired composition of the combustion gases produced. The fuel may be natural gas or other hydrocarbon fuel.

The radiant system R may also be a conventional radiant tube with means for regulating the fuel and air introduced thereinto in such a way that the heat produced may be varied within the necessary limits to supplement that produced by the constantly firing atmosphere producing burners. The control of the heat produced within the radiant tubes is by means of a thermostatic operation, monitored by the thermostat T in the same zone as the radiant tube. If the work load in the furnace should drop so low that the constantly firing atmosphere burners produce too much heat to maintain the desired zone temperature, then one way of absorbing the excess heat is to pass air only through the tubes R. Alternative separate cooling tubes can be provided for extracting the excess heat. Means for thermostatically controlling the operation of the radiant tubes R and/or electrical heating devices E are conventional in annealing furnaces and are incorporated herein by reference. The fundamental difference in the present invention over the conventional annealing furnaces, is that the thermostatic control does not change the operation of the atmosphere producing burners B, but only the radiant tubes R or supplementary electrical heating devices E. The burners B release all of the heat within the annealing furnace so that none is wasted whereas the variation in heat required for varying work load conditions is provided by the automatic thermostat control of the radiant tubes R or electrical heaters E.

From the above description it will be seen that the invention provides a new concept for a bright annealing furnace for copper with integral atmosphere generation which eliminates much of the heat hitherto wasted in conventional furnaces, and has a simplified method of ratio control when the heat load of the furnace changes as processing conditions change.

As described above, and illustrated in the drawings the reference characters B represent the atmosphere producing direct firing burners. They fire at a constant, pre-set rate, to produce the amount of atmosphere required. They are completely indepent of the temperature control system. Therefore, ratio control can be accomplished in the same basic manner and with the same reliability as external atmosphere generation. If desired this ratio can be automatically adjusted by analyzing the furnace atmosphere.

The additional heat required to process more than the minimum amount of copper is produced by a separate system consisting of gas/propane/oil radiant tubes and/or electric heating elements. This heat source is controlled by the furnace temperature control system.

When the production of copper falls below a minimum amount the atmosphere producing system releases more heat than required to keep the furnace at operating temperature. This excess heat is extracted from the furnace interior by passing air through the gas/propane/oil radiant tubes or separate cooling tubes if all secondary heating is electric. The air flow through these tubes is controlled by the furnace temperature control system. In this way heat is only extracted when excess heat is produced, maximizing the utilization of energy.

What I claim as my invention is:

1. In a controlled atmosphere heat treating furnace having a tunnel, the combination of an atmosphere producing device pre-set to fire continuously into said tunnel at a constant rate and ratio independently of any thermostatic control to produce the desired atmospheric composition whereby the heat is constantly released directly within said tunnel independent of any thermostatic regulation, auxiliary means within said tunnel for adding or subtracting heat as required to maintain the desired heat treating temperature and thermostatic means responsive to the temperature within said tunnel for regulating the heat supplied by said auxiliary means independent of the heat constantly released by said atmosphere producing device.

2. The combination according to claim 1, wherein said auxiliary means is a radiant tube means independent of said atmosphere producing device for introducing variable amounts of gaseous fuel and air into said radiant tube but having no effect on the amount of heat constantly released by said atmosphere producing device.

3. The combination according to claim 1, wherein said auxiliary means is an electrical heating device.

4. The combination according to claim 1, wherein said atmosphere producing device is exothermic and the atmosphere produced has a composition which is inert to copper or its alloys at annealing temperatures and in which the work load travelling through the tunnel on the conveyor is copper or its alloys.

5. The combination according to claim 4, wherein said auxiliary means is a radiant tube with means for varying the ratio of fuel plus air thereto to produce the heat required by said thermostatic regulation and in which the atmosphere producing device is pre-set to produce the amount of exothermic heat necessary to maintain the furnace at the desired annealing temperature when the work load is optimum and any variation in temperature due to changing work load is compensated for by the thermostatic regulation of said auxiliary means thereby adding or subtracting heat to maintain said annealing temperature.

6. The combination according to claim 5, wherein said means for varying the ratio can eliminate fuel and introduce air only when said thermostatic regulation requires extraction of surplus heat to maintain the desired temperature.

7. The combination according to claim 1, in which said tunnel includes a series of successive heat treating zones in which different temperatures may be maintained and each zone is provided with at least one of said atmosphere producing devices, at least one of said auxiliary means for adding or subtracing heat and at least one of said thermostatic means for regulating the auxiliary means in the respective heat treating zones.

8. In a controlled atmosphere heat treating furnace having a tunnel, a series of successive heat treating zones and a conveyor for transporting a work load through the successive zones, the combination of a plurality of atmosphere producing burners, each firing directly into one of said heat treating zones and pre-set independently of any thermostatic control to produce the desired atmospheric composition at a constant rate and ratio of fuel and air and to develop sufficient heat in said zone to raise the temperature to approximate heat treating range when an optimum work load is passing through said tunnel, the products of combustion being permitted to travel through successive zones and freely pass through said tunnel to be discharged at the ends thereof, a plurality of separate radiant tube systems each located in one of said heat treating zones each radiant tube being provided with means for selectively introducing fuel and air thereinto in variable amounts to develop heat therein, a plurality of thermostats one in each of said zones and operatively connected to the radiant tube in said zone to regulate the heat developed therein to supplement the heat produced in said zone from said pre-set burner, whereby the temperature of said zone is maintained at heat treating temperature when said work load is varied from said optimum, each of said theremostats being completely independent of the operation of said burners.

* * * * *